US005775343A

United States Patent [19]

Zarn

[11] Patent Number: 5,775,343

[45] Date of Patent: Jul. 7, 1998

[54] HAIR-STYLING DEVICE AND METHOD FOR BRAIDING HAIR

[76] Inventor: Patricia Smith Zarn, 1411 Nottingham St., Orlando, Fla. 32803

[21] Appl. No.: 608,750

[22] Filed: Feb. 29, 1996

[51] Int. Cl.[6] ..... A45D 7/00; A45D 24/06

[52] U.S. Cl. ..... 132/210; 132/133; 132/138

[58] Field of Search ..... 132/200, 210, 132/126, 127, 128, 129, 132, 133, 138, 219

[56] References Cited

U.S. PATENT DOCUMENTS

| | | | |
|---|---|---|---|
| D. 154,205 | 6/1949 | Kovacs et al. | 132/133 |
| 573,887 | 12/1896 | Kraus . | |
| 840,681 | 1/1907 | Becker . | |
| 918,203 | 4/1909 | Schwarzer . | |
| 934,181 | 9/1909 | Jennison | 132/133 |
| 1,596,737 | 8/1926 | Johnson . | |
| 1,635,065 | 7/1927 | Watson | 132/138 |
| 2,455,071 | 7/1948 | Kovacs et al. | 132/133 |
| 2,599,505 | 6/1952 | Witmer | 132/138 |
| 3,998,233 | 12/1976 | Dorr . | |
| 4,108,186 | 8/1978 | Esposto | 132/124 |
| 4,517,998 | 5/1985 | Furco | 132/219 |
| 4,605,020 | 8/1986 | Lavoie | 132/219 |
| 5,174,312 | 12/1992 | Adams | 132/138 |
| 5,240,017 | 8/1993 | Terwilliger | 132/145 |
| 5,261,428 | 11/1993 | Wu . | |
| 5,335,680 | 8/1994 | Moore . | |
| 5,402,805 | 4/1995 | Barinas | 132/133 |
| 5,497,795 | 3/1996 | Hibbard | 132/200 |
| 5,518,011 | 5/1996 | Nash | 132/200 |

FOREIGN PATENT DOCUMENTS

| | | | |
|---|---|---|---|
| 532869 | 11/1956 | Canada | 132/133 |
| 523665 | 7/1957 | Italy | 132/219 |

*Primary Examiner*—Todd E. Manahan

[57] ABSTRACT

A hair-styling device, for french braiding hair, including a first comb detachably secured to a second comb, with each comb vertically disposed in the hair. Each comb has an arcuate spine supporting horizontally extending teeth vertically spaced apart on the spine. The second comb abuts the bottom of the first comb and is disposed in a plane below and parallel to the first comb. The teeth of the second comb are aligned intermediate consecutive teeth on the first comb, and teeth on the first comb are similarly aligned intermediate consecutive teeth on the second comb. This arrangement of the comb teeth separate hair into predetermined sections of hair of uniform thicknesses that are vertically disposed and alternating from side-to-side on the head. The combs are inserted in the hair, a user interweaves the hair sections for braiding. A user then detaches the first comb from the second comb and removes the combs from the hair while retaining the hair braid design.

21 Claims, 1 Drawing Sheet

HAIR-STYLING DEVICE AND METHOD FOR BRAIDING HAIR

FIELD OF THE INVENTION

This invention relates to the field of hair comb devices used for styling hair. More specifically, this invention relates to hair-styling devices for braiding or interweaving hair.

BACKGROUND OF THE INVENTION

A popular hair design over the years has been the french hair braid. Generally in a french hair braid, a person separates the hair into sections of uniform thicknesses and interweaves the hair sections along the back of the head. Inasmuch as the french braid, as with many hair designs, extends along the side or back of the head, the hair must be manipulated by "feel" without a direct view of the head. Accordingly, the braid may contain sections of hair of varying thicknesses creating an uneven weave, or sections of hair are too loosely braided, or the braid is not properly aligned.

Many hair-styling devices assist in styling or designing hair, but these devices do not assist in braiding hair. Moreover, many of these devices are an adaptation or modifications of a barrette and are clipped or secured in the hair to make the hair design. The barrette with a swivelled hinge, U.S. Pat. No. 3,998,233 is a barrette having two halves with a first half hingedly attached to a second half and each has teeth that interlock to secure the barrette in the hair. The Moore patent, U.S. Pat. No. 5,335,680, also discloses a hair clip with two comb halves hingedly secured together with a flexible comb end. In the Wu patent, U.S. Pat. No. 5,261,428, there is a circular hair fastener with an embodiment with teeth having leaf-spring elements made of a resilient material. The spring force of the leaf-springs secure the fastener in the hair.

Other patents that disclose hair design combs include U.S. Pat. No. 573,887 for a curling comb having a vertically displaced comb. The vertical combs divide the hair into plaits which are wound around "cheeks" to create the appearance of hair pins inserted in the hair. The U.S. Pat. Nos. 840,681 and 918,203 disclose hair combs having two combs hingedly mounted together with the teeth of each comb aligned with and overlapping a corresponding teeth of the next comb.

The Johnson patent, U.S. Pat. No. 1,596,737, is a hair waving device having two combs hingedly mounted together with the teeth of the comb intermeshed. When a user's hair is damp, the combs are engaged to crimp the hair and create a wave.

As noted above, these devices clasp the hair for styling and remain in the hair to secure the style. These hair clips, however, do not assist in preparation of a hair braid.

In view of the foregoing-mentioned problems, it is an object of the present invention to provide a hair-styling device that assists in braiding or interweaving one's hair. Another objective is to provide such a device that separates hair into sections of uniform predetermined thicknesses with the sections of hair to be manipulated in a braid. Yet another objective of this invention is to provide such a device that is removable from the hair upon completion of the braid. Still another objective is to provide such a device that is simple to use and inexpensive to manufacture.

SUMMARY OF THE INVENTION

These and other objectives are achieved by the present invention that includes a first comb detachably secured to a second comb. The combs preferably have a curvature to conform to the shape of the head. The first comb has a plurality uniformly spaced apart teeth. The second comb also includes a plurality of teeth uniformly spaced apart. The second comb is attached to the bottom surface of the first comb thus the second comb extends in an arc below and in concentric alignmemt to the first comb. When the two comb halves are secured together, teeth of each comb are disposed intermediate consecutive teeth of the other comb. The combs are vertically disposed on the head so the alternating arrangement of the teeth separates the hair into sections of uniform thicknesses vertically spaced on a head. A user is then able to grasp the separate sections of hair and begin the braiding process. When the user is finished with the braid, he/she simply detaches the combs and removes the combs from the braid.

DETAILED DESCRIPTION OF THE DRAWINGS

Figure 1:
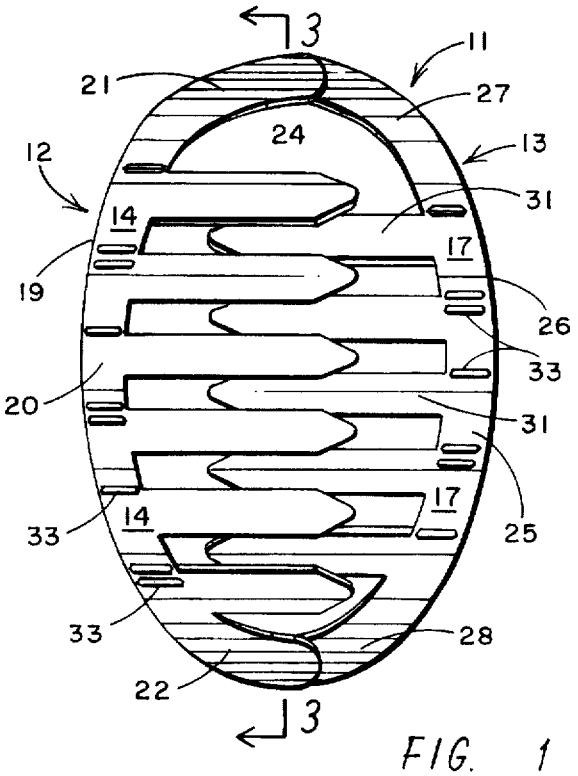
FIG. 1 is a front-elevational view of the invention.
Figure 2:
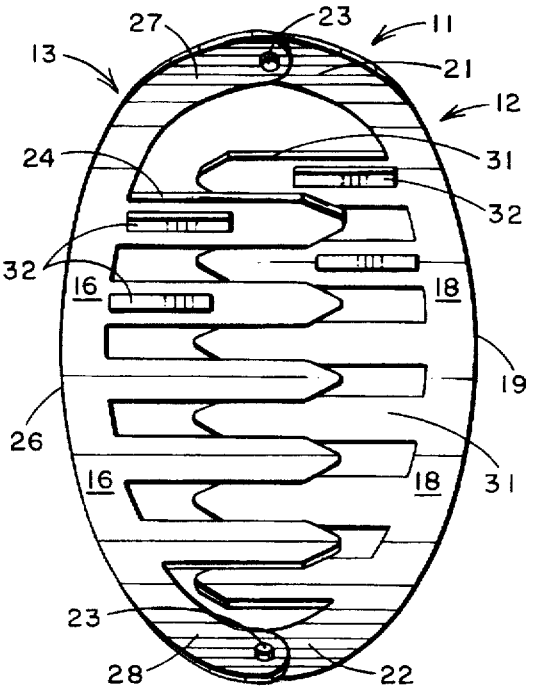
FIG. 2 is a rear-elevational view of the invention.
Figure 3:
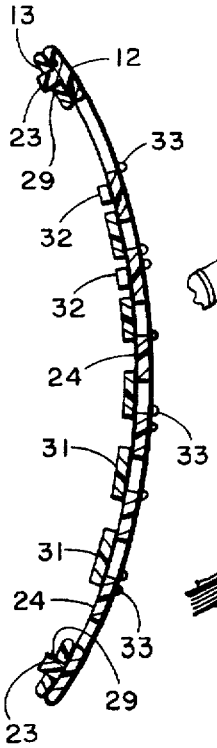
FIG. 3 is a cross-sectional view taken along lines 3—3 in FIG. 1.

The invention, a hair-styling device, is described in more detail below with reference to the FIGS. 1–10. The structure of the hair-styling device is illustrated in FIGS. 1–3. In FIGS. 4–11, the invention is depicted in its intended use for braiding hair.

With respect to FIGS. 1–3, the hair-styling device is designated as 11. The hair-styling device 11 includes a first comb 12 detachably secured to a second comb 13. The first comb 12 has a top surface 14 and a bottom surface 16. Similarly, the second comb 13 has a top surface 17 and a bottom surface 18. As shown in FIGS. 1–3, the first comb 12 is attached to the second comb 13 such that the top surface 17 of the second comb 13 abuts the bottom surface 16 of the first comb 12. Given this attachment, the second comb 13 is disposed in, a arc below and in concentric alignment to defined by the first comb 12.

As illustrated in the cross-sectional view in FIG. 3, the hair-styling device 11 has a slightly concave shape, with respect to a head, to generally fit the contour of a head. In addition, the combs 12 and 13 are constructed of a resilient material, as plastic, so the entire hair-styling device 11 is flexible.

Each of the combs 12 and 13 has a spine supporting a plurality of teeth. The combs 12 and 13 are attached to one another such that the spine and teeth of one comb faces and extends toward the other.

The first comb 12 includes a spine 19. The spine includes a support member 20 that supports teeth 24. An upper arm 21 integral the member 20, bends toward the second comb 13. A lower arm 22, integral the support member 20, also bends toward the second comb 13. This configuration of the support member 20, with upper arms 21 and lower arms 22, provides a generally arcuate shaped spine 19. A pin 23 is mounted to the bottom surface 16 of the first comb 12 on the upper arm 21 and the lower arm 22.

As shown in FIGS. 1 and 2, the spine 19 supports a plurality of teeth 24 that are vertically spaced apart intermediate the upper arm 21 and lower arm 22. When the hair-styling device is vertically disposed on a head, the teeth 24 extend substantially horizontally towards the second comb 13.

The second comb 13 also has a spine 26. The spine 26 has a support member 25. An upper arm 27, integral the top of the support member 25, bends toward the first comb 12. A lower arm 28 integral the bottom of the support member, bends toward the first comb 12, providing an arcuate shape of the second comb 13. The upper arms 27 and lower arms 28 each have an aperture 29 within which the pin 23 on the upper arms 21 and lower arms 22 of the first comb are inserted to secure the first comb 12 and second comb 13 together.

A plurality of teeth 31, integral the support member 25 of the spine 26, are vertically spaced apart intermediate the upper arms 27 and lower arms 28. The teeth 31 extend substantially horizontally toward the first comb 12. As described above, when the second comb 13 is attached to the first comb, the top surface 17 of the second comb abuts the bottom surface 16 of the first comb 12. Thus, the second comb 13, and the teeth 31 on the second comb 13, are disposed in an arc below and in concentic alignment to the first comb 12.

In the embodiment illustrated in FIGS. 1 and 2, the first comb 12 has six teeth 24. The second comb 13, as shown in the embodiment in FIGS. 1 and 2, has five teeth 31. Each tooth 31 of the second comb 13 extends toward the first comb 12 and is centrally aligned intermediate consecutive teeth 24 of the first comb 12 extending in an arc below and in concentic alignment to the first comb 12. Similarly, each of the four middle teeth 24 of the first comb 12 are aligned intermediate consecutive teeth 31 and are positioned in a plane above and parallel the second comb 13 and teeth 31. A marker 33 is adjacent each tooth 24 and 31 of the combs. As described below, the markers 33 are present to identify the respective tooth and hair sections for braiding.

The present invention is not limited to the size of the hair-styling device 11 described herein but may vary according to the nature of the use of the invention. For example, the hair-styling device may be constructed larger to accommodate braiding of a horse's tail. The hair-styling device may also be adapted to accommodate different hair thicknesses. The function of the device remains the same; the attachment of first comb 12 and the second comb 13 in a head of hair separates the hair into sections of uniform thickness for braiding.

Figure 4:
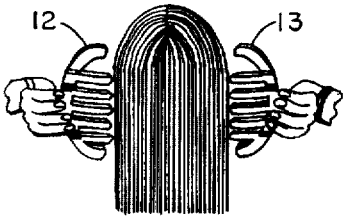
FIG. 4 is a posterior view of a head with the invention prepared for use.
Figure 5:
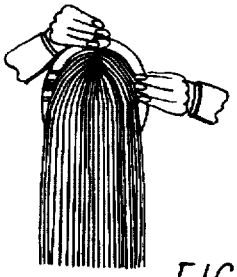
FIG. 5 is a view of the invention secured in a head of hair.

With respect to FIGS. 4–11, there is shown the use of the hair-styling device 11 to form a french braid. In FIG. 4, the first comb 12 is in the left hand of a user, and the second comb 13 is held in the right hand. The combs 12 and 13 are detachably secured together by inserting pins 23 on the first comb 12 into the corresponding apertures 24 of the second comb 13. Small foam rubber pads 32 are attached to the bottom surface of the first comb 12 and second comb 13 to prevent slippage of the device 11 in the hair. As shown in FIG. 5, the point of attachment between the first and second comb 13 is substantially aligned on the center of the head.

When each comb, 12 and 13, is placed in the head section of hair and secured together, the hair-styling device gathers the hair to be braided. Each comb 12 and 13 separates the hair into sections of hair, that extend over corresponding teeth 24 and 31 of each comb 12 and 13. As previously described, the attachment of the first comb 12 to the second comb 13 forms an alternating arrangement of the teeth 24 and 31 of the hair-styling device. When the combs 12 and 13 gather the hair within the hair-styling device 11, the combs 12 and 13 separate the hair in sections, of a predetermined thickness corresponding to a comb tooth. Thus, the hair is divided into a staggered arrangement of hair sections vertically disposed on the back of the head.

As shown in FIGS. 4–11, therein is illustrated a procedure or method of braiding hair using the present invention. One skilled in the art will realize that the size and shape of the devise may be used on different portions of the head. In FIGS. 4 and 5 a user gathers hair within the hair-styling device 11 and combs 12 and 13 partition the hair into the sections of hair as previously described.

Figure 6:
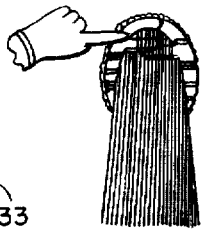
FIG. 6 through FIG. 9 is a view of the invention secured in a head of hair with the hair separated into sections for braiding.
Figure 7:
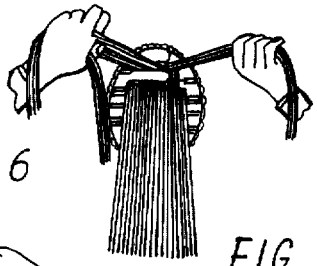
Figure 8:
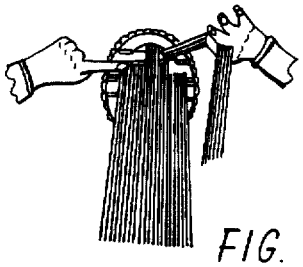
Figure 9:
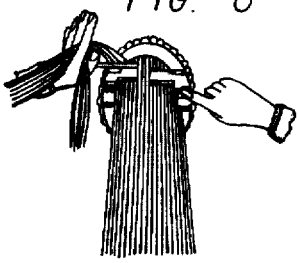
Figure 10:
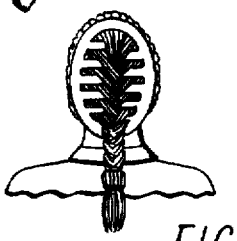
FIG. 10 is a view of the invention with the hair fully braided.
Figure 11:
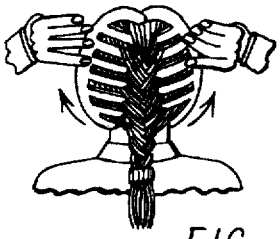
FIG. 11 is a view of the invention separated from a braided head of hair.

The user locates the marker 33 adjacent the first tooth 24 of each comb 12 and 13, and grasps this first section of hair. As shown in FIG. 6, the user then braids this section of hair in a desired fashion. A user then, with the left hand, finds the next marker 33 identifying the next tooth on the first comb 12, grasps a corresponding section of hair and braids this with the first section.

A user then, with the right hand, finds the marker 33 on the second comb 13 adjacent the second tooth 31 of the second comb 13. The user grasps the section of hair separated by the corresponding tooth 31, and braids that hair section into the hair design. The user continues this braiding method, alternating from left to right, or between the first 12 and the second 13 combs, braiding the hair sections into the hair braid or design until the bottom or last hair section is included in the braid. After the braid is complete, the combs 12 and 13 are detached from each other and removed from the hair. The user then has an even and tight hair braid.

While I have disclosed the preferred embodiment of my invention, it is not intended that this description in any way limits the invention, but rather this invention should be limited only by a reasonable interpretation of the now recited claims.

Having thus described my invention, what I claim as new and desire to secure by Letters Patent is:

1. A hair-styling device for braiding or interweaving hair, said device, comprising:

(a) a first comb having a spine supporting a plurality of spaced-apart teeth; and (b) a second comb, detachably secured to the first comb with said second comb disposed in an arc below and in concentric alignment to the first comb, said second comb having a spine supporting a plurality of spaced-apart teeth with each of the teeth of the second comb aligned intermediate consecutive teeth of the first comb and teeth of the first comb aligned intermediate consecutive teeth of the second comb.

2. A hair-styling device, as defined in claim 1, wherein a marker is on the spine of each comb adjacent each comb tooth.

3. A hair-styling device, as defined in claim 1, wherein the device has a concave shape with respect to a head.

4. A hair-styling device, as defined in claim 1, wherein said spine on each of first and second combs includes a support member supporting the comb teeth, an upper arm extending toward the other comb and a lower arm extending toward the other comb forming an arcuate-shaped spine, with said teeth disposed intermediate the upper and lower arms of the comb.

5. A hair-styling device as defined in claim 4, wherein the upper and lower arms of the first comb have a pin attached thereon and the upper and lower arms of the second comb each have an aperture through which the pins are inserted.

6. A hair-styling device, as defined in claim 5, wherein a marker is on the spine of each comb adjacent each comb tooth.

7. A hair-styling device, as defined in claim 6, wherein the hair-styling device has a generally concave shape with respect to a head.

8. A hair-styling device for braiding or interweaving hair, comprising:

(a) a first comb for disposing vertically in the hair, said first comb having a plurality of horizontally extending teeth that are vertically spaced apart;

(b) a second comb for disposing vertically in the hair, said second comb having a plurality of horizontally extending teeth vertically spaced apart; and (c) means, attached to the first and second combs, for detachably securing the first comb to the second comb, such that the said teeth of the second comb are aligned intermediate consecutive teeth of the first comb, and teeth of the first comb are aligned intermediate consecutive teeth of the first, and said second comb is disposed in an arc below and in concentric alignment to the first comb.

9. A hair-styling device, as defined in claim 8, further including a marker on the spine of each comb adjacent each comb tooth.

10. A hair-styling device, as defined in claim 8, wherein said device has a generally concave shape with respect to a head or source of the hair.

11. A hair-styling device, as defined in claim 8, wherein each comb includes a spine having a support member supporting the teeth of the comb, an upper arm and opposing lower arm extending toward the other comb, with said teeth between said arms, forming an arcuate spine.

12. A hair-styling device, as defined in claim 11, wherein said detachable securing means includes a pin attached to the upper and lower arm of the first comb and an aperture in the upper and lower arms of the second combs corresponding to said apertures.

13. A hair-styling device, as defined in claim 12, wherein said device further includes a marker on the spine of each comb adjacent each comb tooth.

14. A hair-styling device, as defined in claim 13, wherein said device has a generally concave shape with respect to a head.

15. A method for braiding hair, comprising the steps of:

(a) inserting in the hair a first comb having a spine supporting a plurality of spaced-apart teeth;

(b) inserting in the hair a second comb having a spine supporting a plurality of spaced-apart teeth with said teeth of the second comb aligned intermediate consecutive teeth of the first comb, and teeth of the first comb aligned intermediate the second comb thereby separating the hair into sections of uniform thicknesses, vertically disposed along a head;

(c) detachably securing said first comb to said second comb; and (d) interweaving the sections of hair to form a braid.

16. A method for braiding hair, as defined in claim 15, further including the steps of detaching the first and second combs and removing the combs from the hair after completing the braid.

17. A method, as defined in claim 15, wherein the securing step includes the step of abutting the first comb on top of the second comb such that said second comb extends in a plane below and parallel said first comb.

18. A method for braiding hair, comprising the steps of:

(a) separating hair into a first set of vertically-disposed sections of hair of uniform thicknesses by inserting a vertically-disposed first comb having a plurality of horizontally-extending teeth;

(b) separating hair into a second set of vertically-disposed sections of hair of uniform thicknesses adjacent said first set of hair sections by inserting a second comb to adjacent the first comb, with said second comb vertically disposed and having a plurality of horizontally-extending teeth;

(c) detachably securing said first comb to said second comb; and (d) interweaving said sections of hair from the first and second combs to form a braid.

19. A method, as defined in claim 18, further including the step of detaching the first comb from the second comb and removing the first and second combs.

20. A method for braiding hair, as defined in claim 18, wherein said securing step includes abutting the first comb on top of the second comb such that said second comb extends in a plane below and parallel the first comb.

21. A method, as defined in claim 20, further including the step of detaching the first comb from the second comb and removing the first and second combs.

* * * * *